US011753764B2

(12) United States Patent
Krepek et al.

(10) Patent No.: US 11,753,764 B2
(45) Date of Patent: Sep. 12, 2023

(54) PROCESS AND DEVICE FOR TREATING OF AT LEAST ONE ARTICLE OF LAUNDRY

(71) Applicant: KREBE-TIPPO TOVARNA INDUSTRIJSKE PRALNE IN PROCESNE OPREME D.O.O., Maribor (SI)

(72) Inventors: Mojca Krepek, Spodnji Duplek (SI); Robert Drevenšek, Maribor (SI)

(73) Assignee: KREBE-TIPPO TOVARNA INDUSTRIJSKE PRALNE IN PROCESNE OPREME D.O.O., Maribor (SI)

( * ) Notice: Subject to any disclaimer, the term of this patent is extended or adjusted under 35 U.S.C. 154(b) by 346 days.

(21) Appl. No.: 17/263,347

(22) PCT Filed: Aug. 24, 2018

(86) PCT No.: PCT/SI2018/050029
§ 371 (c)(1),
(2) Date: Jan. 26, 2021

(87) PCT Pub. No.: WO2020/036539
PCT Pub. Date: Feb. 20, 2020

(65) Prior Publication Data

US 2021/0148040 A1 May 20, 2021

(30) Foreign Application Priority Data

Aug. 16, 2018 (SI) ..... P-201800180

(51) Int. Cl.

| | |
|---|---|
| ***D06F 93/00*** | (2006.01) |
| ***D06F 34/04*** | (2020.01) |
| ***D06F 34/18*** | (2020.01) |
| ***D06F 39/02*** | (2006.01) |
| *D06F 103/06* | (2020.01) |
| *D06F 105/56* | (2020.01) |

(52) U.S. Cl.
CPC ..... *D06F 93/005* (2013.01); *D06F 34/04* (2020.02); *D06F 34/18* (2020.02); *D06F 39/02* (2013.01); *D06F 2103/06* (2020.02); *D06F 2105/56* (2020.02)

(58) Field of Classification Search
CPC ..... D06F 93/005
See application file for complete search history.

(56) References Cited

U.S. PATENT DOCUMENTS

2017/0241066 A1 8/2017 Caspers

FOREIGN PATENT DOCUMENTS

| | | |
|---|---|---|
| EP | 1225267 | 7/2002 |
| EP | 2527517 | 11/2012 |
| KR | 1020080111857 | 12/2008 |
| WO | WO 2006/009375 | 1/2006 |
| WO | WO 2017/206934 | 12/2017 |

*Primary Examiner* — Jason Y Ko
(74) *Attorney, Agent, or Firm* — Robert G. Lev

(57) ABSTRACT

The present invention is a process and system for treating at least one piece of laundry that has a Radio-Frequency Identifier Tag, where the laundry is placed inside a double drum laundry processing system, the system including a receiver for reading signals from the RFID through openings for transmission in the inner drum to provide laundry data to processing unit which controls the cleaning cycle.

9 Claims, 5 Drawing Sheets

PROCESS AND DEVICE FOR TREATING OF AT LEAST ONE ARTICLE OF LAUNDRY

PRIORITY INFORMATION

The subject application is a National Stage Entry of PCT/SI2018/050029, filed on Aug. 24, 2018, and claims priority from Slovenian Application No: P-201800180, filed on Aug. 16, 2018.

Field of the Invention

In general, the present invention relates to the washing and drying of RFID tags on laundry such as linen. In particular, the technical problem to be solved by present invention is inability of RFID tags reader to read RFID tags in concentric washing machine drum used in industrial washing machine applications.

Background Art

Radio-Frequency Identification (hereinafter RFID) is the use of radio waves to read and capture information stored on a tag attached to an object. A tag can be read from up to several feet away and does not need to be within direct line-of-sight of the reader to be tracked. RFID lags are well known to be used in washing machine technology.

RFID tags are emitting a signal to be captured by antenna, for purposes of this specifications also referred to as RFID receiver. This signal is comprising data pre-stored on RFID tag such as identification of the article of laundry, such as linen, or other data characteristic of the piece of laundry. The data can be stored on RFID receiver, or transmitted for further processing to RFID processing unit or elsewhere. RFID processing unit reads the data and transmits the data for further processing. RFID receiver and RFID processing unit can be separated, or joined, and there can be several RFID receivers in series, or in parallel, working on same RFID tag signals.

All of the aforementioned are treated as washing article identifier, and classification mechanism. Below there are several patents describing both RFID tag as used on an article on a piece of laundry, as well as a washing machine used for recognizing said RFID tag and allowing, or disallowing entrance of said article of linen into the washing machine.

However, none of below referenced patents, solves above referenced technical problem of lack of optimized washing cycle programs based on a particular article of linen's reference data.

For example, CN200910253669.0 discloses an RFID electronic tag for a flexible washing identifier, which consists of flexible silicone rubber, transparent glue and a core component, wherein the flexible silicone rubber has an upper layer and a lower layer; the transparent glue is uniformly coated on the inner surfaces of the two layers of the flexible silicone rubber; the core component is arranged in the middle of the flexible silicone rubber and consists of an RFID barechip, a tag antenna, a barechip bonding emboss, an anisotropic conductive adhesive, a synthetic glue and a PET insulating media; the barechip bonding emboss is arranged on the surface of the circuit of the RFID barechip; the anisotropic conductive adhesive is laid between the label antenna and the barechip bonding emboss. The RFID electronic tag has the characteristics of simple structure, contact-free operation, convenient information inquiring and management, realization of automatic sorting and corresponding operation, waterproofness, pressure resistance and thermal resistance, extremely high durability, application in complicated and harsh working environment, repeated use and low cost. A plurality of RFID tags can be read in an instant, so the working efficiency is improved.

Further, CN201520296728.3 discloses water-fast RFID label of washing, include by the flexible parent metal and be in the integrated circuit on the flexible parent metal, the RFID label is encapsulated by silica gel, and wherein the flexible parent metal at the integrated circuit and the position of locating is encapsulated by stereoplasm silica gel, other positions of RFID label are regional than the encapsulation of stereoplasm silica gel soft. The utility model discloses can be applicable to the linen washing management of occasions such as hospital of hotel. Through user state, the washing number of times of RFID reading were automatic recording cloth grass, support that the label when washing hands over reads in batches for the handing-over of washing task becomes simple, transparent, reduces professional dispute. Simultaneously, through trailing the washing number of times, the life of current cloth grass can be predicted for the user, the prediction data is provided for the procurement plan.

Further, KR1020080111857 discloses an apparatus and method for washing clothes using RFID is provided to read easily information on washing method marked RFID attached to laundries. An apparatus and method for washing clothes using RFID comprises a main body, a drum, a door, an opening, a RFID tag reader, an antenna, a driving part, and an input-output part. The main body forms a profile of a washing apparatus and the opening into which laundry is put. The drum is installed inside the main body and has an input part conforming to the opening and rests laundries inside. The door opens and closes the opening. The opening is formed on outer wall of a channel defining the opening and the input part. The RFID tag reader is equipped in the main body, and reads information on laundry from the RFID tag of laundry. The antenna is connected to the RFID tag reader and receives a signal from the RFID tag in wireless way. The driving part exposes the antenna from the input part to the opening in case antenna wirelessly receives signal from the RFID tag and inputs laundries into the main body through the input part during operation of a washing apparatus.

Finally, WO2017206934 discloses an RFTD identification function-based washing machine control method and a washing machine having an RFID identification function. The control method comprises: reading an ID number in an RFID tag of a load of laundry and obtaining information pertaining to each load: displaying the tag information of each load of laundry, and receiving selected-for-deletion information as well as confirmation information: when receiving the selected-for-deletion information, deleting a corresponding load of laundry from a current laundry collection; and when receiving the confirmation information, taking the relevant information of each load of laundry in the current laundry collection as final data.

DETAILED DESCRIPTION OF THE PREFERRED EMBODIMENT

Process and device for treating of at least one article of linen solves above referenced technical problem of inability of RFID tags reader to read RFID tags in concentric washing machine drum used in industrial washing machine applications by strategically placing RFID tag reader, whether in part, or in multi part form in such a way that RFID tags attached to articles of linen can be read even in concentric drums of treatment device such as washer.

For purposes of these specifications, linen refer to any type of article to be treated such as clothing, gloves, shoes, covers, overall, coats and similar items which are in need of treatment such as washing and/or drying.

In industrial washers, the inner drum in which said articles of linen are placed, is positioned within the outer drum of the machine. There is no line-of-sight connection between article of linen with RFID tags attached, and RFID tag reader, if an article of linen is inside inner drum, and RFID tag reader (processing unit) is outside of inner drum. Also, if RFID tag reader is inside inner drum, there is essentially not possible to communicate with outside using radio signals due to nature of inner drum being made of metal, having essentially Faraday Cage Effect. The problem is therefore how to transmit RFID tag signal from inner drum to outside for processing in accordance with this invention, and also, what is nature of processing.

For purposes of this application, RFID tag reader can be comprised of separate RFID tag reader antenna for receiving RFID signal, and separate RFID processing unit to which signals are transmitted via said RFID tag reader antenna, or of single RFID tag reader incorporating all necessary parts to receive, and process information.

For purposes of this application, wording RFID receiver will be used covering both above referenced situation, and also situation where there is an antenna, and transmitter in single housing, regardless of how many such units are needed for a signal to reach final destination. RFID receiver is therefore the first device, or part thereof to intercept said signal from said RFID tag of said at least one article of linen.

There will be two separate embodiments described, one with single RFID tag reader, and another with separate RFID tag reader antenna for receiving RFID signal, and separate RFID processing unit to which signals are transmitted via said RFID tag reader antenna.

As it is well known, metal structures impede transmission of signals, including RFID tags signals. Treatment device drum such as washing machine drum in industrial washing machines qualifies for such a structure. They represent essentially continuous metal construction impeding transfer of signals from RFID tags. Therefore, placing RFID receiver outside said treatment device drum is essentially impossible.

This invention further solves additional problem of lack of optimized washing and drying cycle programs based on particular article of linen reference data by performing steps of (a) reading of data stored on at least one RFID tag as attached to an article of linen (b) processing of said data, said data obtained either from said RFID tag or from server, said server either built into said device or provided for elsewhere, said data chosen from the list consisting of information on material of said article of linen, temperatures related to treating of said article of linen, allowed chemicals to be used in treating of said article of linen, data on machine treating related to said article of linen such as revolution per minute not to be exceeded, and/or combination thereof, (c) storing of said data, characterized in that said process further comprises (d) assembling said data as read from at least two articles of linen to be treated, and (e) searching of appropriate predetermined program based on said data as read from said RFID tags of at least two articles of linen as well as using said process for operating of device for treating of said articles of linen, said treating chosen from the group containing washing, drying and/or combination thereof.

There are several classes of RFID tags, currently as follows:

Doubtlessly, the progress will bring new RFID tags, and this invention is not limited to any particular class.

Furthermore, RFID tags may comprise several types of information from general type of product code, to specific product code, to information on linen such as suggested maximum temperature of washing, suggested maximum number of RPM of centrifuge, suggested maximum temperature of drying, material of linen, suitability of chemicals and similar.

Furthermore, RFID tag reader on the treatment device may be combined with other sensors such as pH level meters or other types of sensors aimed at assessing of quality of water for washing or air for drying.

SUMMARY OF THE INVENTION

Process according to this invention, said treating chosen from the list containing washing, drying, or combination thereof, said treating administered on at least one article of laundry, said article of linen having attached at least one Radio Frequency Identifier (RFID) tag, said RFID tag storing data on said article of laundry, said process for treating of at least one article of laundry comprising the steps of:

(a) loading of at least one article of laundry into treating chamber such as drum of treatment device such as washing machine, drying machine or combination thereof, preferably industrial washing machine drum comprised of moveable inner drum, and non-moveable outer drum, said treating chamber having at least one wall comprised at least partially of metal, said treating chamber moveable, wherein said data stored on at least one RFID tag as attached to at least one article of laundry are to be read by RFID tag reader, said RFID tag reader comprised of at least one RFID receiver and at least one RFID processing unit, said RFID tag reader positioned entirely inside said treating chamber, said reading of said RFID tag comprised of transmitting of said data from RFID tag to at least one RFID receiver by means of a signal, said RFID receiver receiving said data for at least limited time essentially unimpeded by said at least partially metal wall by either:

attaching said RFID receiver to at least one wall of said treating chamber, preferably side wall of inner drum, and attaching said RFID processing unit to another wall of said treating chamber, preferably side wall of outer drum, and having said RFID receiver connected for at least limited time, preferably via Wi-Fi connection, to said RFID processing unit, or providing openings into said treating chamber at least partially metal wall, said openings providing for at least limited time unimpeded transmission of said signal through said metal wall and positioning said RFID receiver outside said treating chamber to receive said data from said at least one RFID tag attached to at least one article of laundry through said openings into said treating chamber at least partially metal wall, or combination thereof;

(b) moving of said treating chamber in order to enable said reading of data stored on at least one RFID tag as attached to at least one article of laundry.

This setup provides access of data by RFID receiver for at least limited time which can be very short such as few milliseconds, and all the way to being constantly provided to RFID receiver.

Process of treating of at least one article of laundry according to this invention wherein said process further comprises the steps of:

(c) providing information related to said at least one article of laundry to treatment device, said information chosen from the list consisting of information on material of said at least one article of laundry, temperature or plurality thereof related to treating of said at least one article of laundry, allowed chemicals to be used in treating of said at least one article of laundry, color of said at least article of laundry; data on machine treating related to said at least one article of laundry such as revolution per minute not to be exceeded, and/or combination thereof; said information on said at least one article of laundry obtained from a source, said source chosen from the list containing at least one server providing information on said at least one article of laundry, said information related to data as read from at least one RFID tag attached to said at least one article of laundry, at least one RFID tag attached to said at least one article of linen;

(d) comparing of said at least one article of laundry compatibility with predetermined program to be used during treatment of said at least one article of laundry;

(e) either allowing of said predetermined program to continue in order for said at least one article of laundry to be treated, or triggering of alarm resulting in predetermined action such as continuation of program, stopping of program, alerting of user, contacting of user using communication device such as mobile or smart phone, or similar.

Process for treating of at least one article of laundry according to this invention wherein said server can be either comprised as integral part of treatment device, or card reader or other type of data reader into which cards or other types of data carriers can be input, or it can be provided separately from said treatment device, for example off-line, or on-line such as store server, or linen manufacturer server, or similar.

Process for treating of at least one article of laundry according to this invention wherein it further comprises the following step: if no RFID tag is detected on any said articles of laundry, and loading of at least one article of laundry is detected, providing this information to user and requesting input, and if none input is given by the user in predetermined time, or by refusing of said user to provide such input, or by other predetermined criteria, or combination thereof, assuming data profile of said at least one article of laundry based on at least one previously loaded article of laundry either in present, or any of previous treatment cycles.

If no RFID tag is detected, the user has many options according to this invention. The user may opt for some sort of averaging process, based on previous data, or based on data of other articles of laundry in same batch, or manual input of data.

The programs for laundry treatment are predetermined. They can be hardwired into device such as washing or drying machine, or they can be programmed by the user.

After RFID tag has been used to properly identify the article of laundry, the processor of said treatment device is assembling the data on all of the load. After checking the database, and obtaining the information on the laundry the program determines whether all of the articles of laundry are compatible. For example, if RFID tag identifies an article of delicate white underwear which has not yet been washed, and another RFID tag identifies an article of organically dark colored cotton article prone to shedding the color, the program may decide to either alert the user, stop itself, or if so preprogramed, to inject suitable chemical to prevent discoloration of said organically dark colored cotton article or if decolorated, neutralizing such color in order to prevent coloration of delicate white underwear.

Process for treating of at least one article of laundry according to this invention wherein it further comprises the following step: if RFID tag has storing capability, communicating to said RFID tag the type of treatment cycle and its conditions so RFID tag can either store this information or communicate to server this information to be used during subsequent treatment of said at least one article of laundry.

Process for treating of at least one article of laundry according to this invention wherein it further comprises the following step: based on predetermined program delivery such as injection or release of cloth impregnated with chemical from a storage such as a reservoir provided to said treatment device of suitable chemical reacting to combination of at least two articles of laundry with different properties such as color.

Process according to this invention will provide for automatic choice of best predetermined program, or for compilation of such program among different instructions, to benefit articles of laundry according to predetermined set of criteria. For example, if there are sensitive articles of laundry included, the program will use least invasive instructions (related to temperature, RPM of centrifuge and similar). If, on the other hand, the articles permit use of higher concentration of chemicals, or if sensors within washing machine will provide information about high concentration of grease or similar, this will also adapt the instructions to the material limit of articles of laundry.

This invention also comprises a treatment device which is adapted to carry out the process according to this invention.

Device for treating of at least one article of laundry according to this invention comprises treatment chamber such as washing or drying compartment such as washing or drying drum, said treatment chamber having at least one wall, said wall at least partially of metal, characterized in that at least one RFID receiver is provided in such a way that signals from at least one RFID tag of at least one article of laundry travel to RFID receiver unimpeded by said at least one wall by either attaching of said RFID receiver to at least one wall of said treating chamber and having said RFID receiver passing information received from said RFID tag to communication means of said device, or by providing openings into said treating chamber metal wall, said openings providing for at least time limited unimpeded transmission of said signal through said metal wall, and positioning said RFID receiver outside said treating chamber.

It should be noted that communications means of said device for treating of at least one article of laundry can be Wi-Fi receiver placed further inside said device.

In the first embodiment RFID receiver is in form of an antenna which attached to side wall of washing machine inner drum. This washing machine drum wall rotates, and so does RFID receiver. Most industrial washing machines have drums composed of inner drum, and outer drum, inner drum rotating, and outer drum serving as sealing device to prevent water loss of washing machine. Both of these drums are completely closed during operation, and can be treated as Faraday-like cage essentially preventing radio signals from escaping. During rotation said RFID receiver reads the signal or plurality thereof from at least one RFID tag of at least one article of linen and receives data from said RFID tag. Said RFID receiver stores said data, until such time that it is able to download said data to RFID processing device which is attached to the side wall of said washing machine outer drum.

Device for treating of at least one article of laundry according to this invention further comprises RFID tag reader attached to said treatment chamber, said RFID tag reader moveable either with said treatment chamber, or independently of said treatment chamber, said RFID tag reader communicating to a processor of data read from at least one RFID tag attached to at least one article of laundry, said arrangement providing information related to said at least one article of laundry to treatment device, said information chosen from the list consisting of information on material of said at least one article of laundry, temperature or plurality thereof related to treating of said at least one article of laundry, allowed chemicals to be used in treating of said at least one article of laundry, color of said at least article of laundry; data on machine treating related to said at least one article of laundry such as revolution per minute not to be exceeded, and/or combination thereof; said information on said at least one article of laundry obtained from a source, said source chosen from the list containing at least one server providing information on said at least one article of laundry, said information related to data as read from at least one RFID tag attached to said at least one article of laundry, at least one RFID tag attached to said at least one article of laundry.

Device for treating of at least one article of laundry according to this invention further comprises means for comparing at least one article of laundry compatibility with predetermined program to be used during treatment of said at least one article of laundry.

The device according to this invention comprises means for comparing of different articles of linen. This means can be a processor, forming part of said treatment device, or being separate from said treatment device and communicating with said treatment device either via wire or wireless. Further, this means can be a program run on a server, said server located in remote location such as at producer of said at least one article, or at a local shop selling said article of linen.

This invention should be useful in arranging of smart washing machine drum which is of aseptic, barrier type, suitable for and used for washing of laundry in medical, pharmaceutical, laboratory, and other establishments, and will provide for reading of RFID tags attached to articles of linen to be washed in such establishment or off-site for such establishments. In such a way, a real-time monitoring and control of washing process will be established as well as use of such system for smart laundry rooms can be envisioned. Human factor which often contributes to directing of laundry into wrong washing drum can be mitigated, and resources such as use of detergent, softener, water or similar. The same system can be used for operation of smart laundry rooms as well as for aseptic or barrier type of laundry treatment often used for users with sensitive laundry or laundry possible exposed to different contaminants. As said, such system prevents incorrect sorting of laundry. In particular embodiment the RFID tag reader will read RFID tags attached to articles of linen and transfer the data into washing machine processor, said washing machine processor will check the data related to articles of linen in database and alert the user if there is incompatible article of linen mixed with the rest of articles of linen in said washing machine drum.

Further, this invention will provide for tracking of washing, so after completion of washing it will be possible to show that particular article of washing underwent particular washing program thereby satisfying the user need. This is particularly sensitive for medical applications as due to aseptic requirement these users need to show that particular article of linen underwent aseptic type of washing.

In addition, use of this invention will provide for automatic choice of best program available which is a benefit in automated industrial laundries as the invention will recognize particular type of linen inside the washing drum and provide for optimum washing program. This will have effect on productivity and on conservation of energy, and water, along with accompanying environ mental impact.

DESCRIPTION OF THE DRAWINGS

The invention is additionally described with help of attached figures, said figures forming part of these specification, and with help of preferred embodiment.

Figure 1:
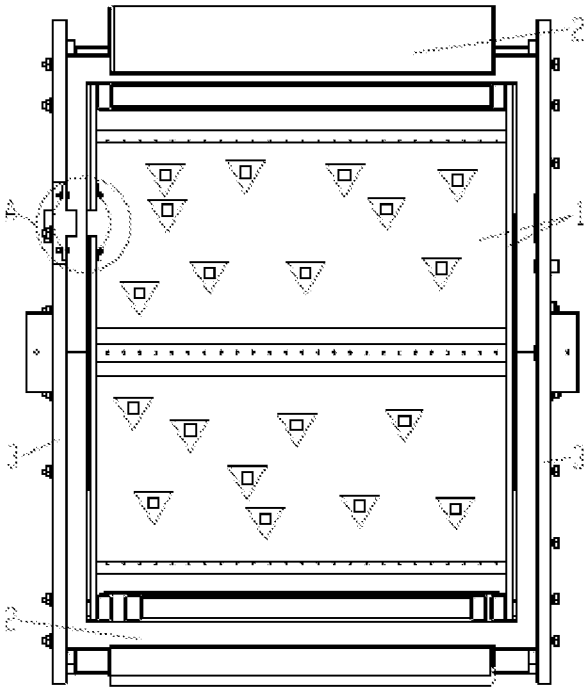
FIG. 1 shows top view of the first embodiment presenting inner drum (1), outer drum (2), side wall of the outer drum (3).
Figure 2:
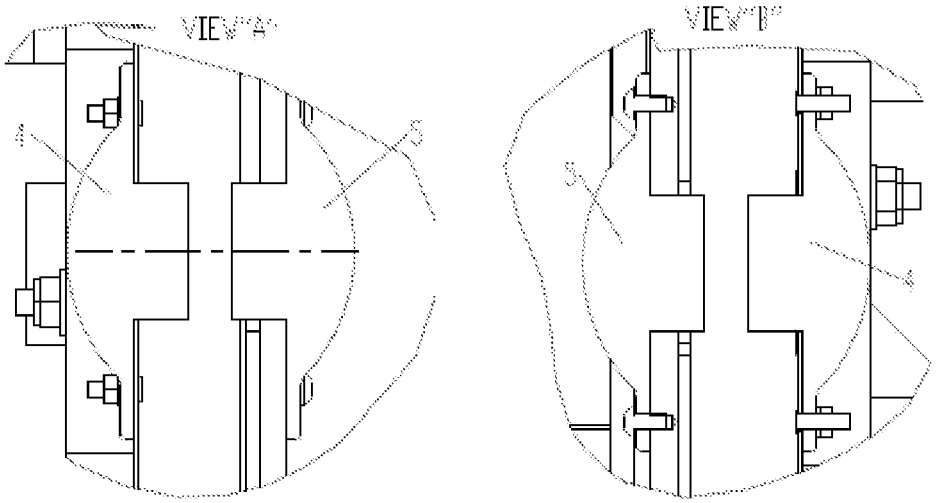
FIG. 2 shows view A from FIG. 1 and view B from FIG. 3, showing RFID processing unit forming part of RFID reader (4), RFID receiver acting as RFID antenna (5).
Figure 3:
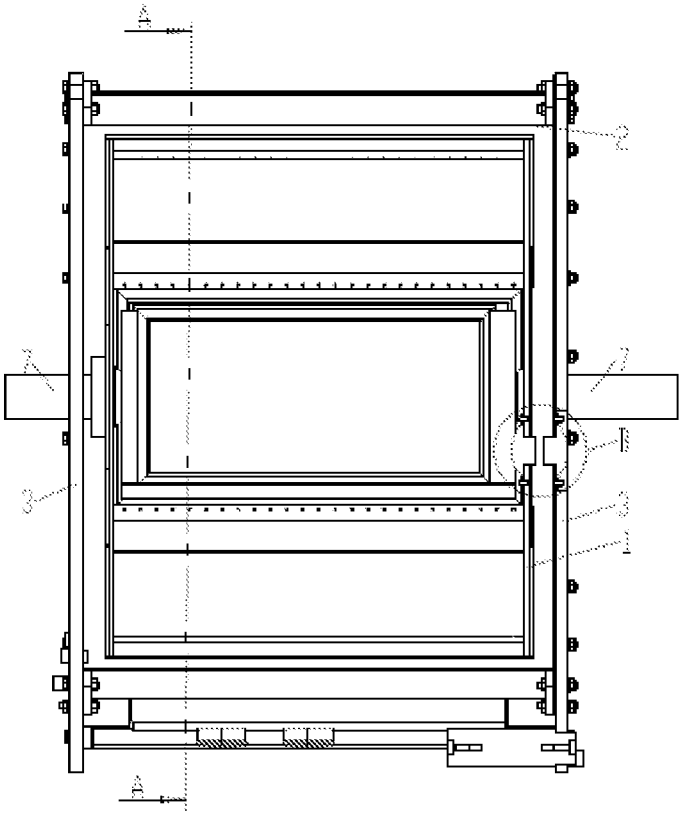
FIG. 3 shows front view of the first embodiment presenting inner drum (1), outer drum (2), side wall of the outer drum (3), axis of the inner drum (7).
Figure 4:
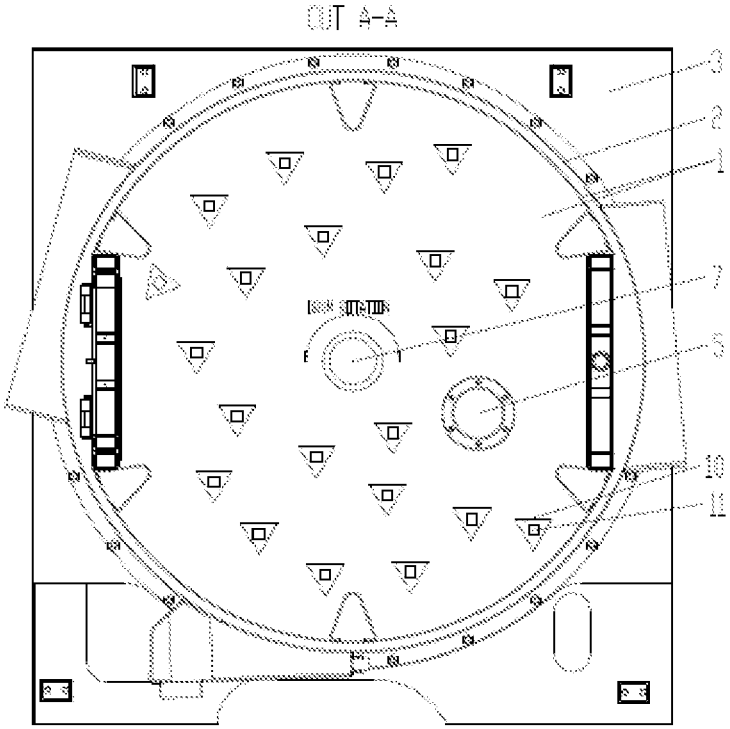
FIG. 4 shows side view of the first embodiment showing articles of linen during washing presenting inner drum (1), outer drum (2), side wall of the outer drum (3), RFID receiver acting as RFID antenna (5), axis of the inner drum (7), article of linen (10), RFID tag on article of linen (11).
Figure 5:
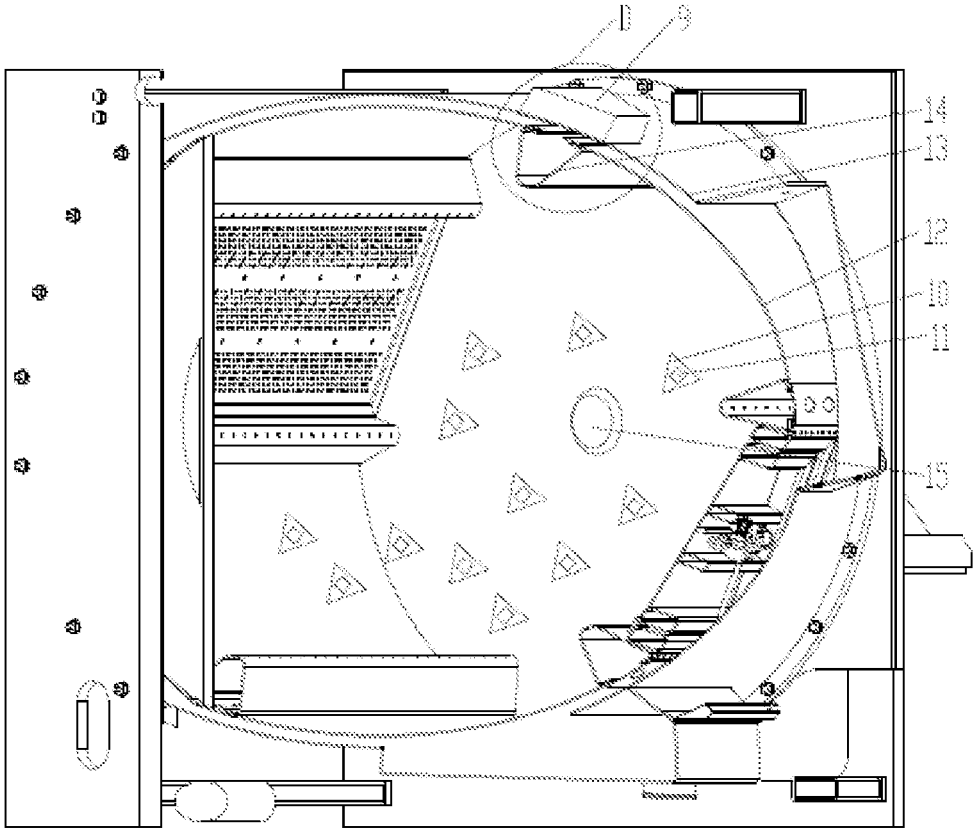
FIG. 5 shows 3D cut-out section of the second embodiment presenting RFID reader comprising both receiver and processing unit (9), article of linen (10), RFID tag on article of linen (11), inner drum (12), outer drum (13), rib (14), axis of rotation (15).
Figure 6:
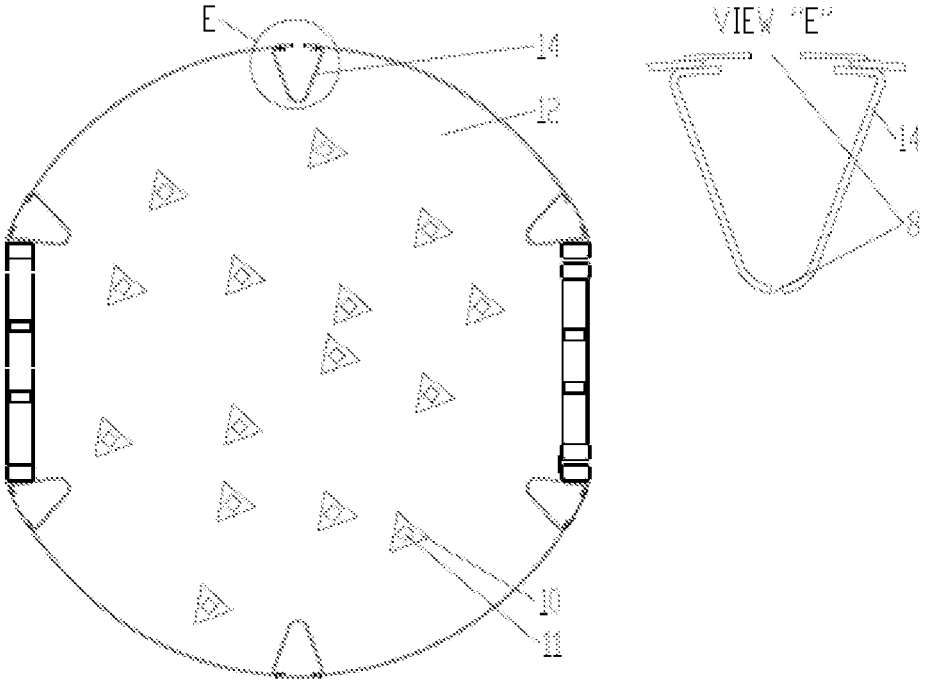
FIG. 6 shows side view of the second embodiment presenting holes (8) (View E) enabling transmission of signals from RFID tag of article of linen, article of linen (10), RFID tag on article of linen (11), inner drum (12), rib (14).
Figure 7:
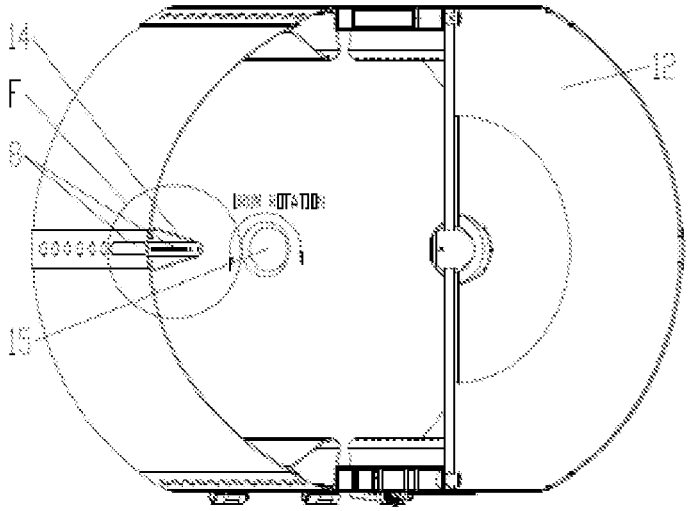
FIG. 7 shows the second embodiment presenting holes (8) enabling transmission of signals from RFTD tag of article of linen, inner drum (12), rib (14), axis of rotation (15).
Figure 8:
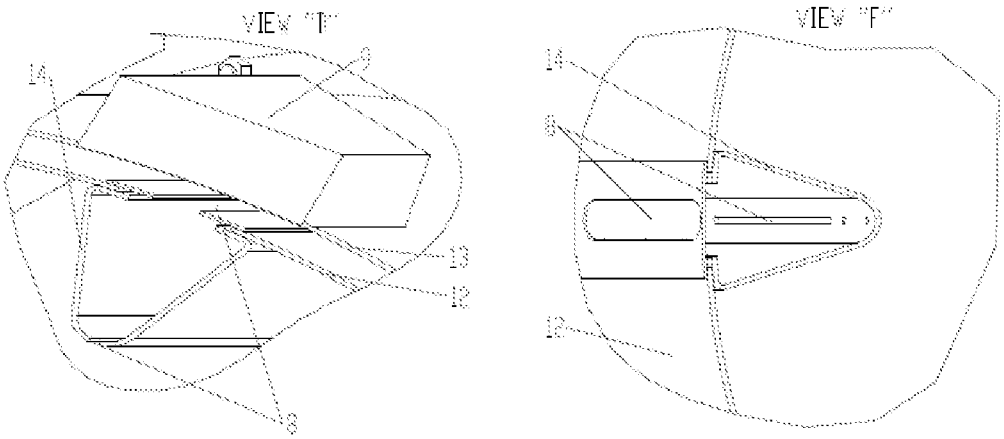
FIG. 8 shows two views (View D from FIG. 5 and View F from FIG. 7) of the second embodiment presenting holes (8) enabling transmission of signals from RFID tag of article of linen, RFID reader comprising both receiver and processing unit (9), inner drum (12), outer drum (13), rib (14).

For purposes of this specification, article of linen is shown as a triangle with little square representing RFTD tag.

FIGS. 1 to 4 show the first embodiment. In this embodiment, RFID reader is made of two devices, RHO receiver acting as antenna (5) and RFID processing unit (4). The system works as follows: the articles of linen (10) with RFID tags (11) attached are input into the inner drum (1) of the washing machine, and are slowly rotated. During this rotation, the articles of linen (10) tumble thus enabling said RFID receiver acting as antenna (5) to read data emitted by RFID tags of said articles of linen. RFID receiver also stores data until such time they are downloaded to RFID processing unit (4). There is no metal wall impeding the signals between said RFID receiver acting as antenna (5) and said RFID tags (11). Said RFID receiver acting as antenna (5) is attached to a side wall of an inner drum and which moves with the rest of the drum, hence said RFID receiver acting as antenna (5) moves with it. The second part of RFID reader, namely RFID processing unit (4) is attached to a side wall of outer drum (3), and does not rotate. Every revolution said RFID receiver acting as antenna (5) and RFID processing unit (4) come in close proximity (shown in Views A and B), and during this time the data stored by said RFID receiver acting as antenna (5) are downloaded to RFID processing unit (4), and from there transmitted further via communication means for further processing. Form of data transmission can be different, but for this embodiment Wi-Fi connection was used.

FIGS. 5 to 8 refer to the second embodiment. In this embodiment, RFID reader comprising both receiver and processing unit (9) is a single unit attached to outer drum (13). The articles of linen (10) with RFID tags (11) are inside the inner drum (12) slowly rotating and tumbling. RFID tags (11) are emitting signals, however these signals are impeded by metal wall of inner drum (12). However, there are holes made in ribs (14) of said inner drum (12), and through these holes signals reach said RFID reader comprising both receiver and processing unit (9) attached to outer drum (13). The signals are then read and transmitted further via communication means for further processing.

Figure 9:
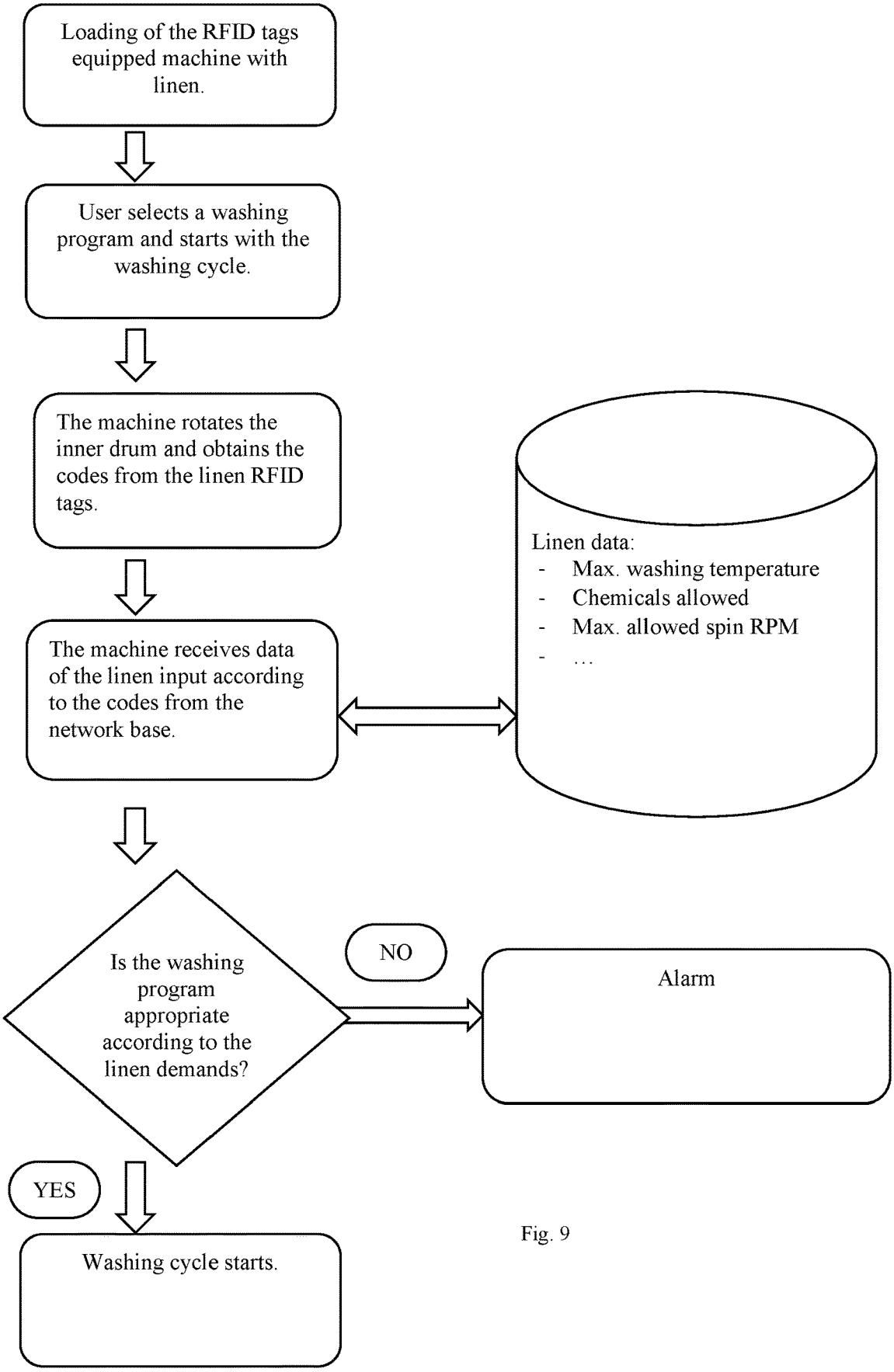
FIG. 9 shows flowchart of one of the processes according to this invention.

FIG. 9 presents flowchart of manual choosing of a program. While automatic choice may be best for most users, more demanding users may want to override the automatic choice in accordance with these specifications depending of their preference or desired result, including and not limited to damaging of said articles of linen to achieve special artistic effect In such a case the steps performed are loading of washing machine drum, said washing machine drum having attached RFID tag reader, with at least one article of linen comprising at least one RFID tag, choice of predetermined program by an user, rotating of said washing machine drum until such time that data stored on said at least one RFID tag are retrieved, obtaining information related to data stored on at least one RFID tag from database, said database either available on washing machine or on server remote from said washing machine, said information including information such as maximum washing temperature, allowed chemicals to be used during washing, maximum allowable centrifuge RPMs and similar. Further, based on obtained information, the processor provided to said washing machine or forming integral part with said washing machine determines whether choice of predetermined program is compatible with at least one article of linen loaded. If the answer is affirmative, the washing machine continues, if it is negative, it alerts the user.

Similar flowchart could be drawn for drying cycle.

The invention claimed is:

1. A process for treating of at least one article of laundry, said treating chosen from the list containing washing, drying, or combination thereof, said treating administered on at least one article of laundry, said article of laundry having attached at least one Radio Frequency Identifier (RFID) tag, said RFID tag storing data on said article of laundry, said process for treating of said at least one article of laundry comprising the steps of:

(a) loading of said at least one article of laundry into a chamber having a drum of a treatment device including one of a washing machine, a drying machine and a combination thereof, said treating chamber comprising a moveable inner drum, and non-moveable outer drum, said treating chamber having at least one wall comprised at least partially of metal, said treating chamber moveable, wherein said data stored on at least one RFID tag as attached to said at least one article of laundry are to be read by RFID tag reader, said RFID tag reader comprised of at least one RFID receiver and at least one RFID processing unit, said RFID tag reader positioned entirely inside said treating chamber, said reading of said RFID tag comprised of transmitting of said data from RFID tag to at least one RFID receiver by means of a signal, said RFID receiver receiving said data for at least limited time essentially unimpeded by said at least partially metal wall by either:

(i) attaching said RFID receiver to at least one side wall of said inner drum, and attaching said RFID processing unit to a side wall of said outer drum, and having said RFID receiver connected for at least limited time, via Wi-Fi connection, to said RFID processing unit, or (ii) providing openings into said treating chamber at least partially metal wall, said openings providing for at least limited time unimpeded transmission of said signal through said metal wall, and positioning said RFID receiver outside said treating chamber to receive said data from said at least one RFID tag attached to said at least one article of laundry through said openings into said treating chamber at least partially metal wall, or (iii) combination thereof;

(b) moving of said treating chamber in order to enable said reading of data stored on at least one RFID tag as attached to said at least one article of laundry.

2. A process of treating of at least one article of laundry according to claim 1, wherein said process further comprises the steps of:

(c) providing information related to said at least one article of laundry to treatment device, said information chosen from the list consisting of information on material of said at least one article of laundry, temperature or plurality thereof related to treating of said at least one article of laundry, allowed chemicals to be used in treating of said at least one article of laundry, color of said at least article of laundry; data on machine treating related to said at least one article of laundry such as revolution per minute not to be exceeded, and/or combination thereof; said information on said at least one article of laundry obtained from a source, said source chosen from the list containing at least one server providing information on said at least one article of laundry, said information related to data as read from at least one RFID tag attached to said at least one article of laundry, at least one RFID tag attached to said at least one article of laundry;

(d) comparing of said at least one article of laundry compatibility with predetermined program to be used during treatment of said at least one article of laundry;

(e) either allowing of said predetermined program to continue in order for said at least one article of laundry to be treated, or triggering of alarm resulting in predetermined action such as continuation of program, stopping of program, alerting of user, contacting of user using communication device such as mobile or smart phone, or similar.

3. A process for treating of at least one article of laundry according to claim 2, wherein said server can be either comprised as integral part of treatment device, or card reader or other type of data reader into which cards or other types of data carriers can be input, or it can be provided separately from said treatment device, for example off-line, or on-line such as store server, or a manufacturer server of said at least one article of laundry, or similar source.

4. A process for treating of at least one article of laundry according to claim 3, wherein said process it further comprises the following step: if no RFID tag is detected on any said articles of laundry, and loading of at least one article of laundry is detected, providing such information to user and requesting input, and if none input is given by the user in predetermined time, or by refusing of said user to provide such input, or by other predetermined criteria, or combination thereof, assuming data profile of said at least one article of laundry based on at least one previously loaded article of laundry either in present, or any of previous treatment cycles.

5. A process for treating of at least one article of linen according to claim 4, wherein said process further comprises the following step: if RFID tag has storing capability, communicating to said RFID tag the type of treatment cycle and its conditions so RFID tag can either store this information or communicate to server this information to be used during subsequent treatment of said at least one article of linen.

6. A process for treating of at least one article of linen according to claim 5, wherein said process it further comprises the following step: based on predetermined program delivery such as injection or release of cloth impregnated with chemical from a storage such as a reservoir provided to said treatment device of suitable chemical reacting to combination of at least two articles of linen with different properties such as color.

7. A device for treating of at least one article of laundry, said device comprising: a treatment chamber such as washing or drying compartment such as washing or drying drum, said treatment chamber having at least one wall, said wall at least partially of metal, characterized in that at least one RFID receiver is provided in such a way that signals from at least one RFID tag of said at least one article of laundry travel to RFID receiver for at least limited time unimpeded by said at least one wall by either:

(a) attaching of said RFID receiver to at least one wall of said treating chamber and having said RFID receiver passing information received from said RFID tag to communication means of said device, or (b) by providing openings into said treating chamber metal wall, said openings providing for at least limited time unimpeded transmission of said signal through said metal wall, and positioning said RFID receiver outside said treating chamber.

8. A device for treating of at least one article of laundry according to claim 7, wherein said device further comprises an RFID tag reader attached to said treatment chamber, said RFID tag reader moveable either with said treatment chamber, or independently of said treatment chamber, said RFID tag reader communicating to a processor of data read from at least one RFID tag attached to said at least one article of laundry, said arrangement providing information related to said at least one article of laundry to treatment device, said information chosen from the list consisting of information on material of said at least one article of laundry, temperature or plurality thereof related to treating of said at least one article of laundry, allowed chemicals to be used in treating of said at least one article of laundry, color of said at least article of laundry; data on machine treating related to said at least one article of laundry such as revolution per minute not to be exceeded, and/or combination thereof; said information on said at least one article of laundry obtained from a source, said source chosen from the list containing at least one server providing information on said at least one article of laundry, said information related to data as read from at least one RFID tag attached to said at least one article of laundry, at least one RFID tag attached to said at least one article of laundry.

9. A device for treating of at least one article of laundry according to claim 8, wherein said device further comprises means for comparing at least one article of laundry compatibility with predetermined program to be used during treatment of said at least one article of laundry.

* * * * *